United States Patent [19]

Stevens, Jr.

[11] 3,933,282

[45] Jan. 20, 1976

[54] UNIVERSAL TAVERN UNIT FOR KEG TAPPING DEVICE

[75] Inventor: Frederick F. Stevens, Jr., Fairfield, Conn.

[73] Assignee: Hoff-Stevens, Inc., Ansonia, Conn.

[22] Filed: Feb. 4, 1974

[21] Appl. No.: 439,540

[52] U.S. Cl. ..... 222/400.7; 137/515.7; 137/525.1

[51] Int. Cl.[2] ..... B65D 83/00

[58] Field of Search ..... 222/400.7, 400.8; 137/515.7, 525.1

[56] References Cited

UNITED STATES PATENTS

| | | | |
|---|---|---|---|
| 879,604 | 2/1908 | Wawrzinski | 222/400.7 |
| 996,588 | 6/1911 | Kennedy | 137/515.7 |
| 3,189,046 | 6/1965 | Callahan et al. | 137/515.7 |
| 3,228,413 | 1/1966 | Stevens, Jr. | 222/400.7 X |
| 3,357,602 | 12/1967 | Sichler | 222/400.7 |
| 3,618,632 | 11/1971 | Stevens | 137/525.1 X |

*Primary Examiner*—Robert B. Reeves
*Assistant Examiner*—David A. Scherbel
*Attorney, Agent, or Firm*—McCormick, Paulding & Huber

[57] ABSTRACT

A universal tavern unit for a keg tapping device comprises a basic tavern unit for connection to a keg unit permanently or semi-permanently connected to a keg. The basic tavern unit is adapted to cooperate with the keg unit to provide inlet and outlet passageways which commuicate with the interior of the keg for the introduction of gas under pressure into the keg and the discharge of beer or other liquid therefrom. The universal tavern unit further includes a pressure relief check valve adaptor assembly for connection to the basic tavern unit to adapt it to the requirements of an associated beer or liquid distribution system.

6 Claims, 4 Drawing Figures

UNIVERSAL TAVERN UNIT FOR KEG TAPPING DEVICE

BACKGROUND OF THE INVENTION

This invention relates in general to keg tapping devices and deals more particularly with an improved tavern unit for use with a keg unit permanently or semi-permanently connected to a keg to dispense liquid from the keg. The present invention relates more specifically to a universal tavern unit for a keg tapping device of the type shown and described in my U.S. Pat. No. 3,228,413 for Keg Tapping Device, issued Jan. 11, 1966, and assigned to the assignee of the present invention. The device of the aforementioned patent includes a keg unit and a tavern unit for connection thereto. The tavern unit has inlet and outlet passageways which communicate with the interior of a keg when the keg unit is attached to the keg and the tavern unit is connected to the keg unit. The inlet passageway is partially defined by an inlet tube which has a pressure relief valve mounted thereon for automatically bleeding gas from the keg to maintain pressure in the keg at a safe level in the event that pressure tends to rise above such level. It is also customary to provide a check valve at the inlet end of the latter tube to prevent retrograde gas or liquid flow in a conduit connected to the inlet tube and to a source of gas under pressure. The pressure relief valve and check valve are considered essential elements in a single keg dispensing system; that is, a system wherein the tapping device is connected to a single keg and to a source of gas under pressure for dispensing beer or the like from the keg to a tap or spigot. However, in a tavern or restaurant where a large quantity of beverage must be dispensed in a relatively short time, tapping devices of the aforedescribed type may be used in a multiple keg or series connected system which assures a constant supply of beverage for a prolonged period without interruption for removal and replacement of empty kegs. Such a system generally comprises a plurality of kegs or barrels each of which has a tapping device of the aforedescribed general type connected thereto. The tapping devices on the kegs are connected together in series with each other between a source of gas under pressure and a tap or spigot. In a beverage dispensing system of the aforedescribed type, it is generally desirable to use only one check valve on the tapping device associated with the keg nearest the gas pressure source. The check valves associated with the remaining tapping devices are preferably removed from the other tavern units which comprise the system to permit unobstructed fluid flow through the lines connecting the various kegs and to the tapping spigot. However, if the unnecessary check valves are not removed, when the system is installed, malfunction or abnormal flow at the spigot may result. Since it is usually difficult for one not thoroughly familiar with such a system to locate the source of the latter problem, the system may remain out of operation until the condition is corrected by a qualified repairman. Further, if the tavern unit has a relief valve permanently connected thereto when the tavern unit is used in a multi-keg system with other tavern units of like kind, the system will contain a plurality of unrequired relief valves, all of which add unnecessary expense to the installation. Accordingly, it is the general aim of the present invention to provide a universal tavern unit which may be adapted for use in either a single keg or multi-keg dispensing system to simplify installation of a system and minimize its cost.

SUMMARY OF THE INVENTION

In accordance with the present invention, a universal tavern unit is provided which includes a basic tavern unit having an inlet tube suitable for connection to a flexible conduit and an adaptor assembly which includes a pressure relief valve and a check valve for connection to the inlet tube, as required, to adapt the basic tavern unit to the particular requirements of an associated keg tapping system.

DETAILED DESCRIPTION OF THE PREFERRED EMBODIMENT

Figure 1:
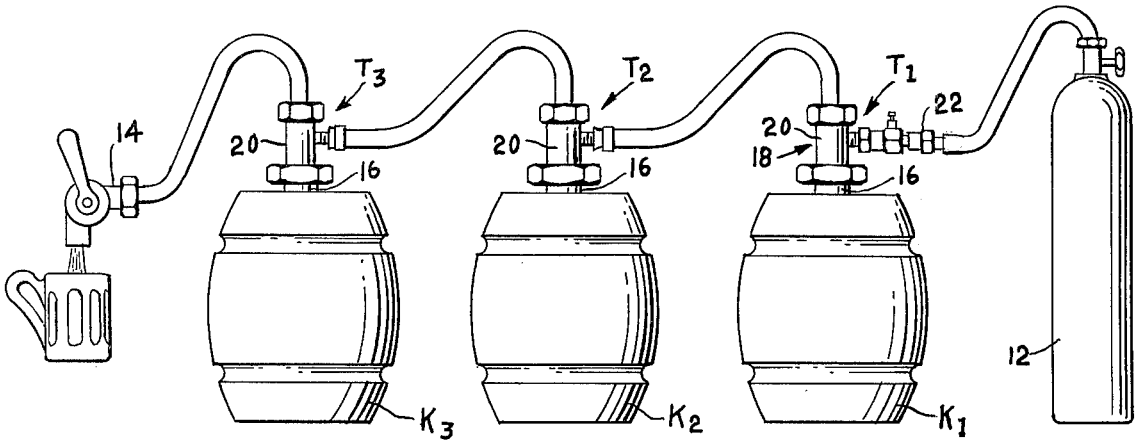
FIG. 1 is a somewhat schematic side elevational view of a multiple keg tapping system which includes a keg tapping device having a universal tavern unit embodying the invention.

Referring now to the drawing, in FIG. 1, a multiple keg tapping system is shown which comprises a plurality of kegs designated $K_1$, $K_2$ and $K_3$. Each keg is provided with an associated tapping unit designated $T_1$, $T_2$ and $T_3$. The tapping units respectively communicate with the interior of the kegs and are connected together in series with each other and with a source of gas under pressure, illustrated by the gas cylinder 12, and a tap or spigot 14. The tapping device $T_1$ associated with the keg $K_1$ comprises a keg unit 16 and a universal tavern unit indicated generally at 18 which includes a basic tavern unit 20 and a pressure relief-check valve assembly or adaptor 22. The tapping devices $T_2$ and $T_3$ each comprise a keg unit 16 and a basic tavern unit 20.

Figure 2:
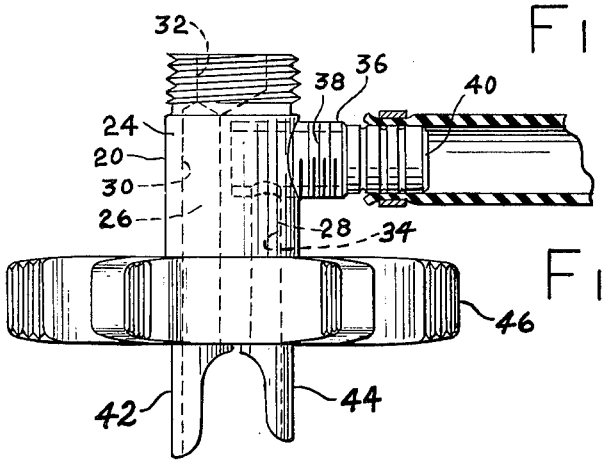
FIG. 2 is a somewhat enlarged side elevational view of a basic tavern unit.

Considering now the basic tavern unit 20 in further detail and referring particularly to FIG. 2, the basic unit has a generally cylindrical body 24 which has two passageways 26 and 28 therein, shown in broken lines in FIG. 2 and adapted to respectively communicate with bores in a keg unit (not shown) when the basic tavern unit 20 is connected to the keg unit. The passageway 26 is defined by a cylindrical bore 30 parallel to an offset from the central axis of the body 24. The bore 30 does not pass completely through the upper end of the body 24 and at its upper end communicates with a short bore 32 coaxial with the axis of the body 24. The passageway 28 is defined by another bore 34 which opens through the lower end of the body 24. At its upper end, the bore 34 communicates with a short cylindrical tubular part 36 which projects in a radial direction from the body 24. A male thread 38 at the inner end of the part 36 threadably engages the body 24 and extends outwardly for some distance beyond the body 24. The tubular part 36 has a cylindrical portion of somewhat reduced diameter at its outer end. More specifically, the outer end portion of the tubular part 36 has an outside diameter not greater than the root diameter of the thread 38. In the illustrated embodiment, the latter end portion has a plurality of shallow annular recesses formed therein to aid in retaining a flexible elastomeric tubular conduit or the like in connected relation with the basic tavern unit 20 as shown in FIG. 2. At its outer end, the tubular part 36 has a generally radially disposed and axially outwardly facing bearing surface 40, best shown in FIG. 4. Tubular probes 42 and 44 respectively received in enlarged portions of the bores 30 and 34 extended downwardly from the body 24 in generally parallel relation to further define the passageways 26 and 28. An internally threaded union nut 46 surrounds the body 24 and bears against an annular flange 48 (FIG. 3) at the lower end thereof for retaining the basic tavern unit in connected relation with an associated keg unit 16.

When the tavern unit is in connected relation with the keg unit, the probes 42 and 44 are received in associated passageways in the tavern unit and maintain valves associated with the tavern unit in an open condition to provide communication between the passageways 26 and 28 and the interior of an associated keg. Reference may be had to my aforementioned U.S. patent for more complete disclosure of the manner in which a tavern unit such as the unit 18 cooperates with an associated keg unit.

Figure 3:
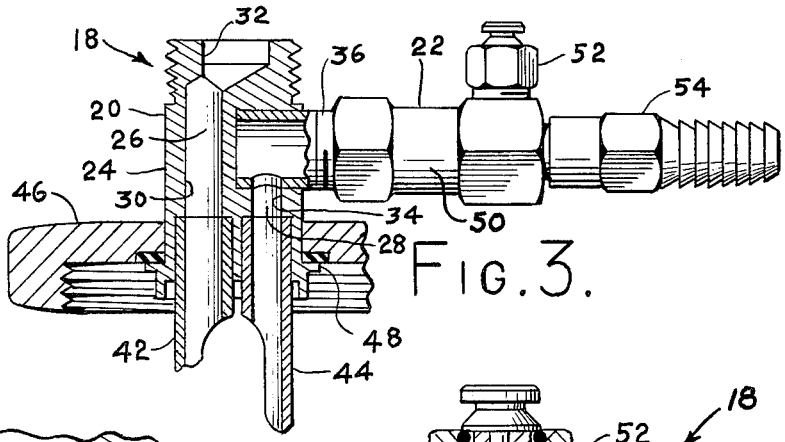
FIG. 3 is a side elevational view of a universal tavern unit embodying the present invention shown partially in vertical section.
Figure 4:
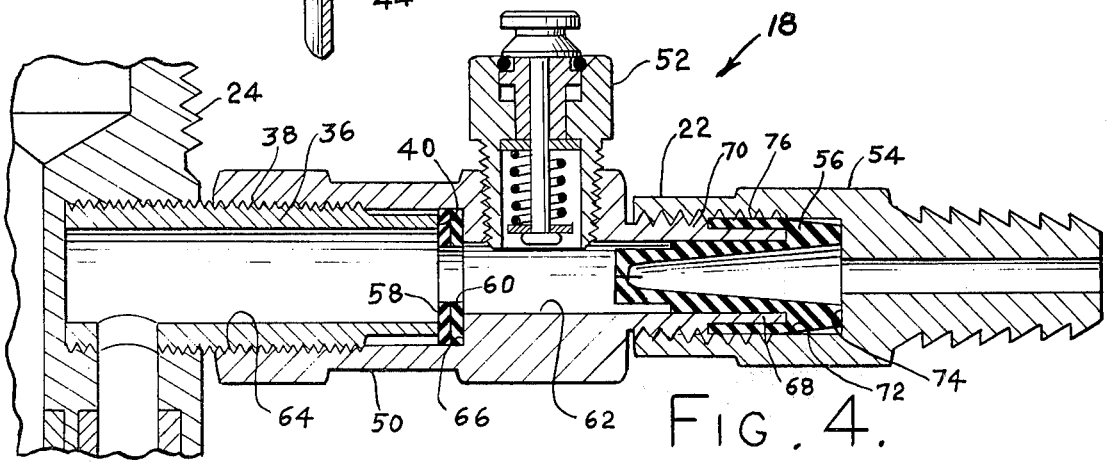
FIG. 4 is a somewhat enlarged fragmentary longitudinal sectional view through the universal tavern unit of FIG. 3.

Referring now particularly to FIGS. 3 and 4 and further considering the construction and arrangement of the pressure relief-check valve adaptor 22, the adaptor generally comprises a first tubular part 50 for connection to the tubular part 36 and which carries a pressure relief valve 52. The adaptor 22 further includes a second tubular part 54 for connection to the tubular part 50 to retain a check valve such as indicated at 56 and to provide means for connecting the tavern unit inlet passageway 28 to a flexible tubular conduit associated with a gas pressure source such as the gas cylinder 12, as shown in FIGS. 1. At least one annular seal member provides a fluid tight seal between the tubular parts 36 and 50 when the adaptor 22 is attached to the basic tavern unit 20. In the illustrated case, two such annular seal members are provided and designated at 58 and 60, FIG. 4, for a further purpose hereinafter explained.

Considering the adaptor 22 in further detail, the part 50 has a stepped bore 62 which extends coaxially therethrough. The inner end portion of the bore is somewhat larger than the outer end portion thereof and has a female thread 64 for engaging the male thread 38 on the tubular part 36. A generally radially disposed and axially inwardly facing sealing surface 66 is defined by the part 50 intermediate the bore sections thereof. The part 50 also has a cylindrical portion 68 at its outer end and a somewhat larger male threaded portion 70 spaced from its outer end.

The pressure relief valve 52 is threaded into the side wall of the tubular part 50 between the sealing surface 66 and the outer end of the part as shown in FIGS. 3 and 4. Nut-like configurations on the outer surface of the part 50, as shown in FIG. 3, are provided for receiving a wrench or the like to facilitate assembly of the adaptor 22 with the basic tavern unit 20.

The second tubular part 54 has a stepped bore 72 which extends coaxially therethrough. The inner end portion of the latter bore is somewhat larger than the outer end portion thereof and includes a female thread for connection with the threaded portion 70 when the parts 50 and 54 are telescopically joined. At the junction of its bore sections the part 54 has a generally radially disposed and inwardly facing bearing surface 74. At its outer end, the part 54 has a saw-tooth configuration for receiving and releasably retaining the end portion of a flexible conduit (not shown) telescopically connected thereto.

The elastomeric check valve 56 is received within the outer end of the bore 62, extends outwardly for some distance there beyond, and has a generally cylindrical sleeve portion indicated at 76 which surrounds the cylindrical outer end portion 68. The bearing surface 74 on the part 54 bears against the outer end of the check valve 56 and serves to retain it in assembly with the part 50. The inner end portion of the check valve is divided into half sections by an axially extending slit formed therein, the half sections being adapted for flexure to permit the passage of fluid in one direction therethrough. The sleeve portion 76 and the outer end portion of the check valve 56 cooperate with the parts 50 and 54 to provide a fluid tight seal therebetween. For a more complete disclosure of the check valve 56 and the manner in which it cooperates with two fluid conduits such as the parts 50 and 54 to provide a seal therebetween, reference may be had to my U.S. Pat. No. 3,618,632 entitled Check Valve, issued Nov. 9, 1971 and assigned to the assignee of the present invention.

When the adaptor 22 is connected to the basic tavern unit 20, it is preferable that the pressure relief valve 52 be disposed on the upper side of the inlet tube as shown in FIGS. 3 and 4. This arrangement is particularly desirable for sanitary reasons, when the system is used in dispensing a beverage such as beer or the like. The preferred check valve arrangement assures fluid drainage from the spring receiving cavity in the relief valve 52. A plurality of sealing washers of differing thickness, such as the washers 58 and 60, are provided for use in connecting the adaptor 22 to the basic tavern unit 20 to assure proper positioning of the relief valve. At least one annular washer such as 58 selected from the group of sealing washers is positioned within the bore 62 generally adjacent the sealing surface 66. Thereafter, the adaptor 22 is threaded into engagement with the tubular part 36. If the relief valve 52 cannot attain its desired angular position relative to the body 24 when a predetermined torque is applied to threadably connect the adaptor 22 to the tubular part 36, then the adaptor 22 is disconnected from the tavern unit. Thereafter, one or more additional washers selected from the group are positioned therebetween and the adaptor is again connected to the tavern unit. This procedure may be repeated until the proper washer or combination of washers is selected which yields the desired result. In the illustrated case the two sealing washers 58 and 60 were employed to bring the pressure relief valve 52 to its desired vertically oriented position.

When a keg tapping device, such as aforedescribed, is used to tap a single keg, the universal tavern unit 18, which includes both a basic tavern unit 20 and an adaptor 22, is employed, since both the pressure relief valve 52 and the check valve 56 comprise essential elements in such a single keg system. However, in a multiple keg tapping system, it is necessary to provide only one universal tavern unit 18 for attachment to one of the kegs in a system. Basic tavern units are provided for attachment to the remaining kegs. Thus, the manufacturer of a tapping device may produce a single tavern unit which meets the requirements of all systems and the user of the tapping device is not required to purchase unnecessary hardware. Such simplified installation instructions will virtually assure proper installation of the system and trouble free service.

I claim:

1. In a keg tapping apparatus having a keg unit for connection to a keg, the improvement comprising a universal tavern unit having a body for connection to the keg unit and including means defining fluid passageways through said body for communicating with the interior of the keg when the keg unit is connected to the keg and the tavern unit is connected to the keg unit, a cylindrical tubular part connected to the body and extending outwardly therefrom, said cylindrical tubular part partially defining one of said fluid passageways and having a generally radially disposed axially outwardly facing annular bearing surface thereon, a pressure relief-check valve adaptor assembly including a first tubular part having a radially disposed axially inwardly facing sealing surface, a male thread on one of said parts comprising said cylindrical part and said first tubular part and a female thread on the other of said parts for threadable engagement with said male thread for releasably connecting said first tubular part to said cylindrical part, a pressure relief valve mounted on said first tubular part intermediate its ends and communicating with the interior thereof, said pressure relief valve extending radially outwardly from said first tubular part, a second tubular part, means for releasably connecting said second tubular part to said first tubular part, an elastomeric check valve disposed in one of said first and second tubular parts and having means associated therewith for cooperating with said first and second tubular parts to provide a substantially fluid tight seal between said first and second tubular parts when the latter parts are connected, and at least one annular sealing and positioning washer selected from a plurality of washers of differing axial thicknesses, said one washer disposed between said cylindrical part and said first tubular part in sealing engagement with said bearing surface and said sealing surface, said one washer causing said pressure relief valve to attain a generally predetermined angular position relative to said body when a generally predetermined torque is applied to threadably connect said first tubular part to said cylindrical part with said one washer therebetween.

2. In a keg tapping apparatus as set forth in claim 1 the combination wherein said one part comprises said cylindrical tubular part and said other part comprises said first tubular part.

3. In a keg tapping apparatus as set forth in claim 2 the combination wherein said bearing surface is disposed at the outer end of said cylindrical tubular and said male thread is spaced axially inwardly of said outer end.

4. In a keg tapping apparatus as set forth in claim 3, wherein said male thread extends to said inner end of said cylindrical tubular part and comprises means for connecting said cylindrical tubular part to said tavern unit body.

5. In a keg tapping apparatus having a keg unit for connection to a keg, the improvement comprising a universal tavern unit having a body for connection to the keg unit and including means defining fluid passageways through said body for communicating with the interior of the keg when the keg unit is connected to the keg and the tavern unit is connected to the keg unit, said tavern unit having a cylindrical tubular part connected to said body and extending outwardly therefrom, said cylindrical tubular part having a cylindrical bore partially defining one of said fluid passageways and having a male thread on its surface spaced from its outer end and a generally cylindrical outer end portion of reduced diameter, said outer end portion defining a generally radially disposed outwardly facing annular bearing surface, and a pressure relief-check valve adapter assembly including a first tubular part having a stepped first bore extending coaxially therethrough, said first bore including a diametrically enlarged inner end portion having a female thread on its interior surface threadably engaging said male thread and telescopically connecting said first tubular part to said cylindrical tubular part in coaxial alignment therewith, said first tubular part defining a radially disposed axially inwardly facing annular first sealing surface between said inner and outer end portions of said first bore in axially opposing relation to said bearing surface, said first tubular part having a cylindrical outer end portion and an externally threaded portion of somewhat larger diameter than its cylindrical portion and spaced from its outer end, at least one annular seal member disposed between and sealingly engaging said bearing surface and said first sealing surface, a pressure relief valve supported by and projecting radially outwardly from the side wall of said first tubular part between said sealing surface and said externally threaded portion and communicating with the outer end portion of said first bore, a second tubular part having a stepped second bore extending coaxially therethrough and having an inner end portion somewhat larger than its outer end portion, said second bore inner end portion having a female thread thereon engaging said externally threaded portion and telescopically connecting said second tubular part to said first tubular part in coaxial alignment therewith, said second tubular part defining a generally radially disposed axially inwardly facing annular second sealing surface in said second bore between the inner and outer end portions thereof, said second tubular part having an outer end portion including means for receiving and releasably retaining the end portion of a flexible conduit in telescopic connection therewith, and an elastomeric check valve received in the outer end portion of said first bore and extending axially outwardly for some distance therebeyond and sealingly engaging said second sealing surface, said elastomeric check valve having a generally cylindrical sleeve portion in surrounding sealing engagement with said cylindrical outer end portion of said first tubular part, said elastomeric check valve having an axially extending slit therein dividing the inner end portion thereof into half sections adapted for flexure to permit the passage of fluid in one direction through said check valve from said second bore to said first bore.

6. In a keg tapping apparatus as set forth in claim 5 the combination wherein said one annular seal member comprises at least one annular sealing and positioning washer selected from a plurality of washers of differing axial thickness for causing said pressure relief valve to attain a generally predetermined angular position relative to said tavern unit body when a generally predetermined torque is applied to threadably connected said first tubular part to said cylindrical tubular part with said one washer therebetween.

* * * * *